US007152292B2

(12) United States Patent
Quell et al.

(10) Patent No.: US 7,152,292 B2
(45) Date of Patent: Dec. 26, 2006

(54) ROLLER FOLDING HEAD

(75) Inventors: Ewald Quell, Fulda/Sickels (DE); Manfred Hohmann, Hünfeld (DE); Marc Burzlaff, Dipperz (DE)

(73) Assignee: EDAG Engineering + Design AG, Fulda (DE)

( * ) Notice: Subject to any disclaimer, the term of this patent is extended or adjusted under 35 U.S.C. 154(b) by 172 days.

(21) Appl. No.: 10/487,726

(22) PCT Filed: Aug. 29, 2002

(86) PCT No.: PCT/DE02/03217

§ 371 (c)(1),
(2), (4) Date: Sep. 15, 2004

(87) PCT Pub. No.: WO03/024641

PCT Pub. Date: Mar. 27, 2003

(65) Prior Publication Data

US 2005/0015955 A1 Jan. 27, 2005

(30) Foreign Application Priority Data

Aug. 31, 2001 (DE) ..... 101 42 698

(51) Int. Cl.
*B23P 19/00* (2006.01)

(52) U.S. Cl. ..... 29/243.5; 29/283.5; 29/509; 72/210; 72/220; 72/226; 901/41

(58) Field of Classification Search ..... 29/505, 29/509, 513, 283.5, 243.5, 243.58; 403/274, 403/282, 285; 72/199, 210, 226, 237, 241.2, 72/252.5, 365.2, 366.2, 372, 220; 901/30, 901/41

See application file for complete search history.

(56) References Cited

U.S. PATENT DOCUMENTS

| | | | | | |
|---|---|---|---|---|---|
| 3,015,293 | A | * | 1/1962 | Parham | 29/509 |
| 4,470,186 | A | * | 9/1984 | Knudson | 29/243.5 |
| 4,726,107 | A | * | 2/1988 | Knudson | 29/243.5 |
| 5,184,384 | A | * | 2/1993 | Lipp | 29/243.5 |
| 5,228,190 | A | * | 7/1993 | Sawa | 29/715 |
| 5,267,387 | A | * | 12/1993 | Sawa | 29/509 |
| 5,784,915 | A | * | 7/1998 | Allemann et al. | 72/211 |
| 6,477,879 | B1 | * | 11/2002 | Sawa | 72/220 |

FOREIGN PATENT DOCUMENTS

| | | | |
|---|---|---|---|
| EP | 0577876 | A | 1/1994 |
| EP | 1097759 | A | 5/2001 |
| JP | 02070325 | A * | 3/1990 |
| WO | WO-0062955 | A1 | 10/2000 |

* cited by examiner

*Primary Examiner*—Jermie E. Cozart
(74) *Attorney, Agent, or Firm*—Crowell & Moring LLP

(57) ABSTRACT

A roller folding head is disclosed. Roller folding heads are used, for instance, when fixing the frame of a sliding roof in an opening in the roof of a vehicle. In order to do this quickly and automatically, the roller folding head is provided with at least two pairs of rollers, each pair of rollers consisting of a pressure roller and a counter-roller which interact in order to bend a flange along a folding line at a specific angle. The folding process is carried out in several stages, one flange being crimped around another flange in a series of partial steps at an angle of 180°. One pair of rollers is provided for each step, at least two thereof being arranged on a roller folding head.

4 Claims, 4 Drawing Sheets

ROLLER FOLDING HEAD

BACKGROUND AND SUMMARY OF THE INVENTION

This invention relates to a roller folding head.

Such roller folding heads, which are coupled with a robotic arm and are guided by the arm, are used, e.g., in the automobile industry in order to connect sheet metal together by means of folding operations. One area of application is, for example, the connection of the frame of a sliding roof with the edge of an opening in the roof of a vehicle.

A roller folding head that is suitable for such an operation must be adapted to the respective space requirements in the individual case and may not introduce any forces into the body of the vehicle during the folding operation. In addition, there should be as few swapping operations as possible.

The invention provides for solving the problem a roller folding head for fastening to a robotic arm with two pairs of rollers, each pair of rollers comprising a pressure roller and a counter-roller, both of which interact to bend a flange at a specific angle along a folding line, and with a base body and a carriage that can slide along the base body, the pressure rollers being mounted on the carriage so as to rotate.

Since, according to the above, two pairs of rollers are disposed at the roller folding head, at least two successive folding operations can be carried out. By means of the carriage, to which the pressure rollers are fastened, the pressure rollers are moved into the respective working position.

The two flanges, which are supposed to be connected together by means of the folding operation, are, first of all, parallel to each other, the one flange projecting beyond the other. The projecting segment of the one flange is gradually beaded 180° about the other flange in several steps. To carry out the first step, the pressure roller of the first pair of rollers has a conically expanding folding segment, which is forced against the projecting segment and bends this projecting segment to about 45°. So that the counter-roller of this pair of rollers can be guided behind the bent-over segment, it is pivot-mounted on another carriage which can be moved relative to the base body. The counter-roller of the second pair of rollers takes over the beading operation at another 45° and, therefore, does not have to be held moveably at the base body. Rather it is mounted at the base body in such a manner that it cannot slide.

Preferably the two carriages are arranged at the base body in such a manner that they can be moved perpendicularly in opposite directions. The result is a compact construction of the roller folding head.

It is true that each pair of rollers can be formed by one pressure roller and one counter-roller each, both of which are assigned only to this pair. Hence, four pairs of rollers yield eight individual rollers. To reduce the number of rollers, it is provided that one pressure roller can be assigned to any arbitrary counter-roller to form a pair of rollers. Thus, the system of roller pairs can comprise, for example, two pressure rollers and four counter-rollers, where one of the pressure rollers interacts in succession with three of the counter-rollers.

Preferably these counter-rollers are coupled with one revolver head, which is connected to the base body.

Secondly, the invention relates to a method for folding a flange in four steps, wherein at least three different pairs of rollers are used with the goal being a curl of 180°.

As to be explained in detail below, the first pair of rollers can be definitely used both for the first and for the final fourth folding step. In principle two procedures are possible. First, two roller folding heads with different pairs of rollers can be used. Secondly, a single roller folding head can be used, where the counter-roller of a pair of rollers can be swapped by means of a changing device so that a total of four different pairs of rollers is conceivable.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
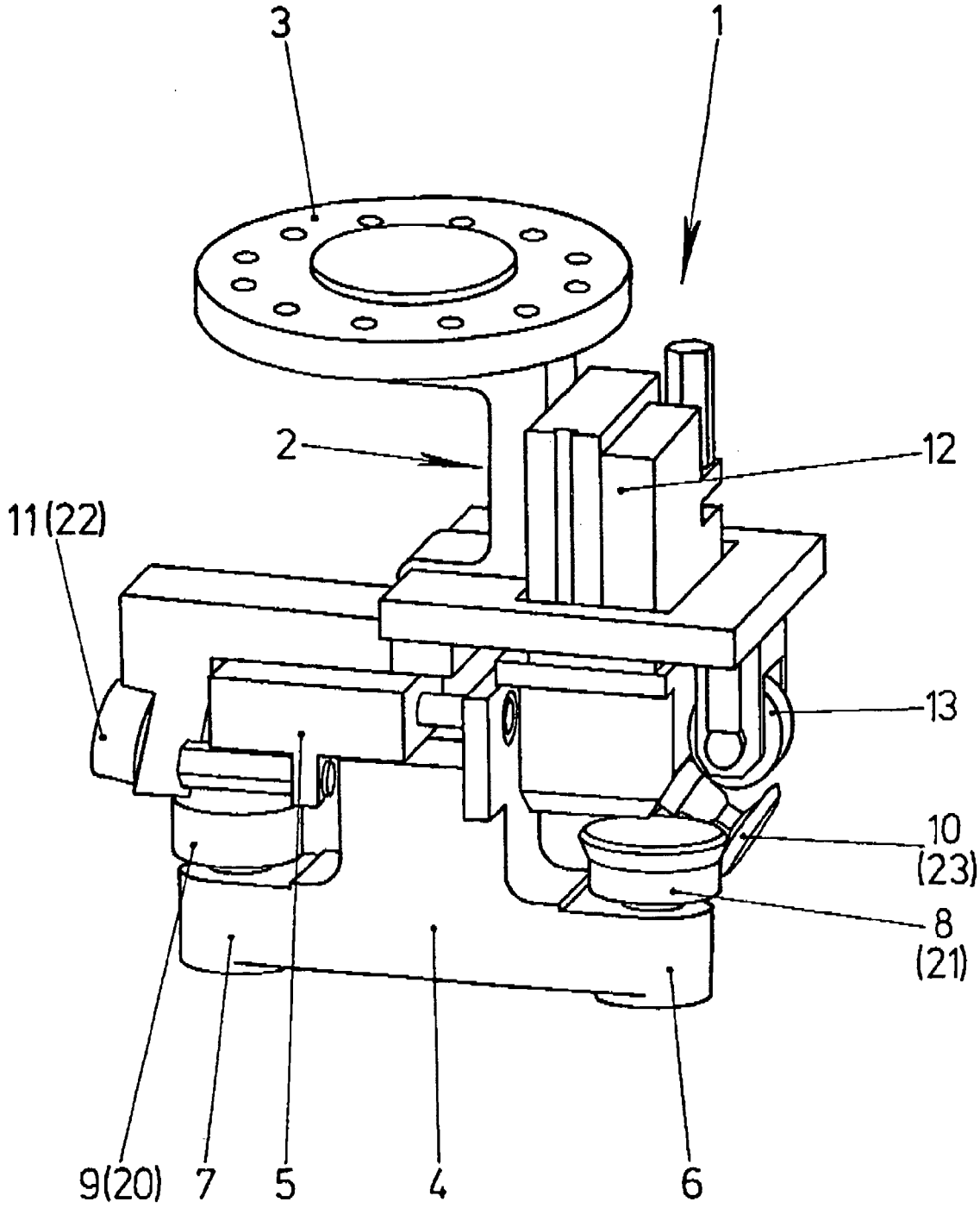
FIG. 1 is a perspective view of a roller folding head according to a first embodiment of the instant invention.

FIG. 1 depicts a first embodiment of a roller folding head 1. This head comprises a U-shaped base body 2. A flange plate 3 for fastening to a robotic arm is mounted on a leg of the base body 2. On the side of the base body 2 opposite the flange plate 3 there is a carrier 4 at a first pneumatically moveable carriage 5.

The T-shaped carrier 4 has two arms 6, 7, of which the one arm 6 carries a first pressure roller 8, and the other arm 7 carries a second pressure roller 9. One counter-roller 10, 11 acts together with both pressure rollers 8, 9. The first counter-roller 10, which interacts with the first pressure roller 8, is disposed on another carriage 12, which is held moveably at the base body 2, the two carriages 5, 12 enclosing a right angle. The second counter-roller 11 is pivot-mounted directly on the end of one leg of the base body 2. Moreover, the base body 2 carries a force absorbing roller 13.

For the method for folding a flange (described below), a second roller folding head is used that corresponds to the roller folding head, depicted in FIG. 1. The second roller folding head carries a third and a fourth pressure roller 20, 21, as well as a third and fourth counter-roller 22, 23, where, however, the fourth counter-roller 23 is held at the base body 2 in such a manner that it cannot be displaced. In addition, the rest of the carriage 12 is replaced by a wedge-shaped holder.

Figure 2:
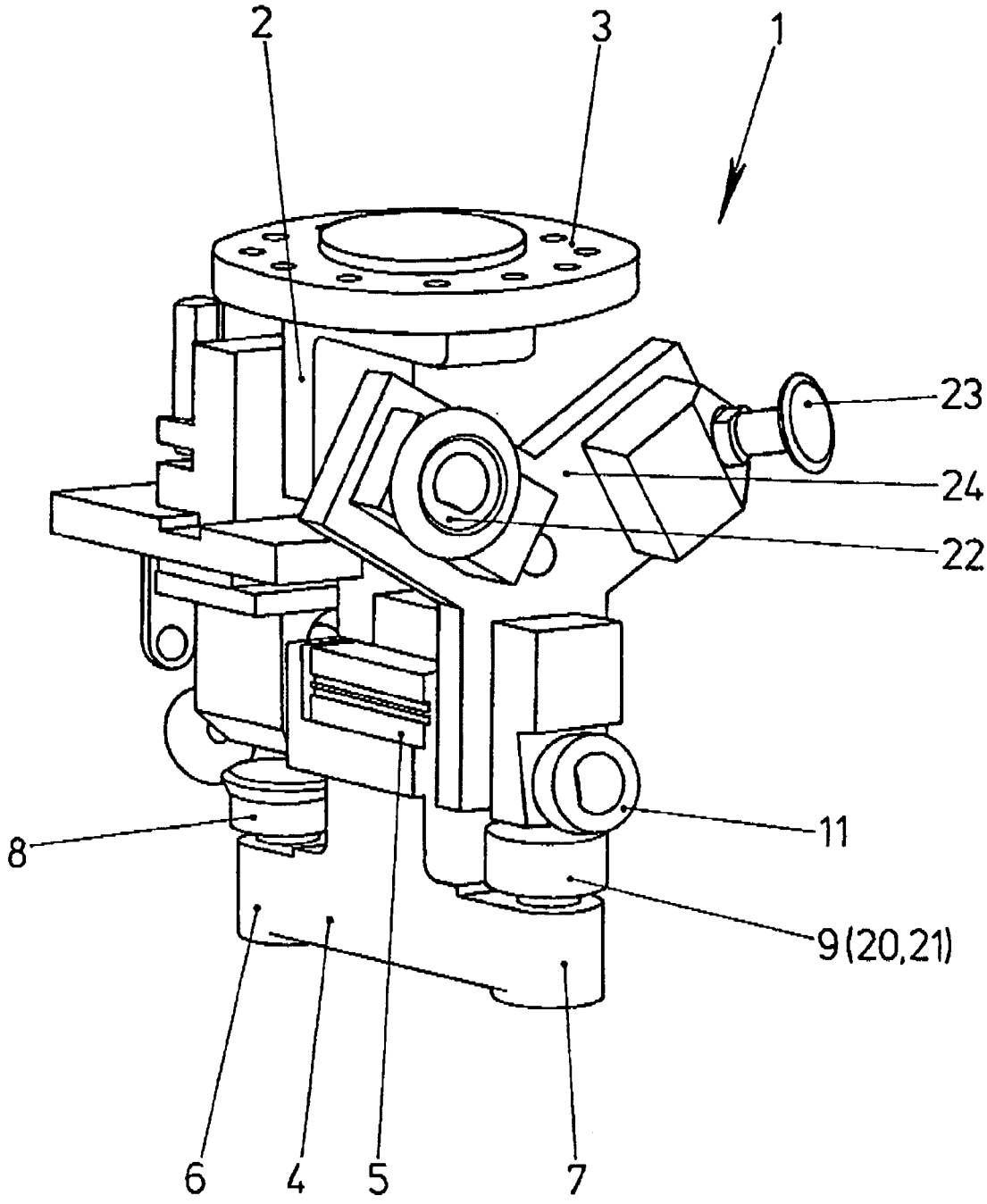
FIG. 2 is a perspective view of a roller folding head according to a second embodiment of the present invention.

In place of the two roller folding heads, one roller folding head can also be used in accordance with FIG. 2. In this embodiment, the second, the third and the fourth counter-roller (11, 22, 23) are mounted on a revolver head 24, which forms a changing device, on the base body 2. The second pressure roller 9 interacts with one of the three counter-rollers (11, 22, 23) as a function of the position of the revolver head 24, so that a second, third or fourth pair of rollers is formed.

To illustrate how the two roller folding heads of FIG. 1 or the roller folding head with the revolver head 24 of FIG. 2 work, reference is made to FIGS. 3*a* to 3*d*. They show the connection of a roof 30 to the frame 31 of a sliding roof. The roof 30 carries an opening, the opening edge being set up so as to form a flange 32, which runs approximately perpendicular to the surface of the roof 30.

The frame 31 ends in a leg 33, which runs parallel to the flange 32. The flange 32 is higher than the leg 33, thus producing a connection between the roof 30 and the frame 31 in that the projecting portion of the flange 32 is bent 180°. around the leg 33. This is done in four folding operations, which are shown little by little in the FIGS. 3*a* to 3*d*. In each step the projecting portion of the flange 32 is bent over approximately 45°. For each step, a pair of rollers is provided.

Figure 3A:
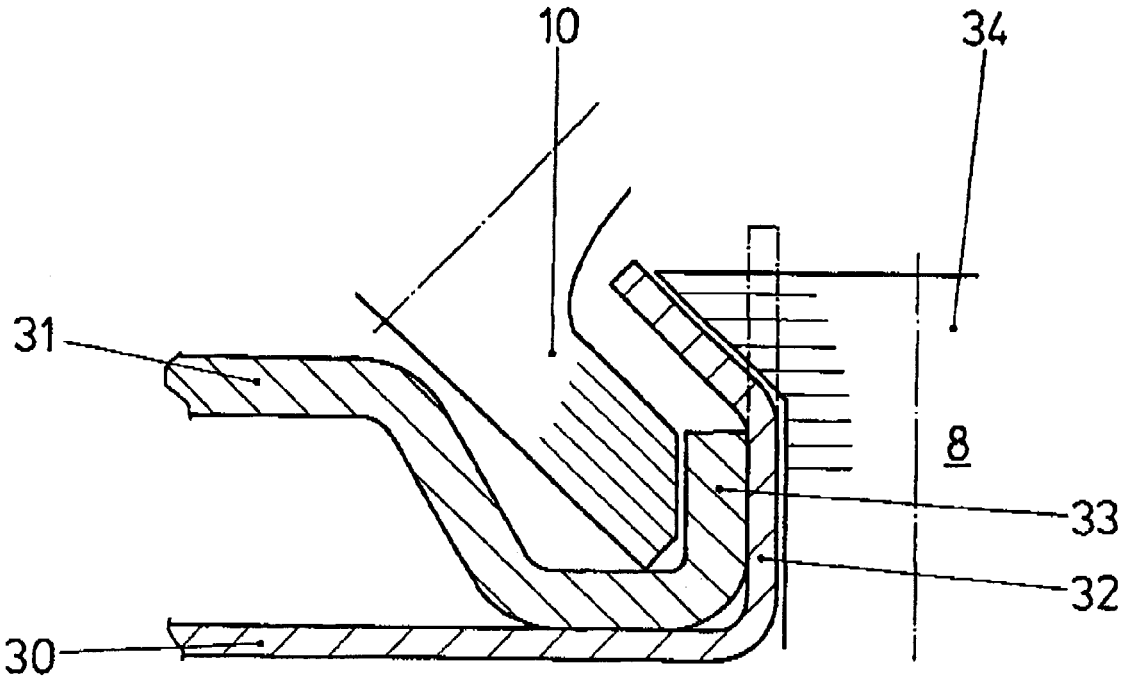
FIGS. 3*a*–3*d* are schematic elevational views partly in cross-section, of the steps in forming a flange of an auto roof and a frame according to the inventive method.

In the first step, according to FIG. 3*a*, the first pressure roller 8 works together with the first counter-roller 10. The first pressure roller 8 carries a conically expanding folding segment 34, the conicity of which corresponds to the intended bending of the flange 32. A cylindrical segment of the first pressure roller 8 rests against the flange 32. To brace against the forces introduced into the body of the car by this operation, the first counter-roller 10 runs inside along the leg 33. Thus, no forces are introduced into the frame 31 or into the roof 30.

Figure 3B:
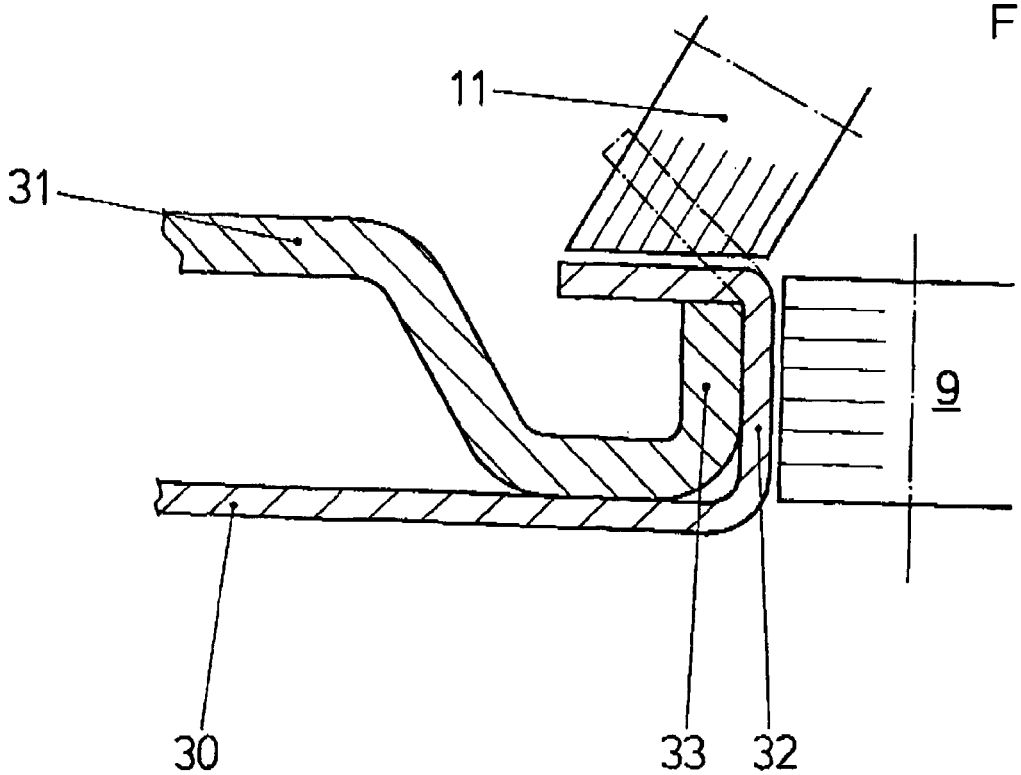

In the second step according to FIG. 3*b*, the second pressure roller 9 works together with the second counter-roller 11. The second pressure roller 9 is a cylinder without a conical segment. The counter-roller 11, also called the folding roller, which is positioned at a slight angle, pushes the flange 32 down another 45°.

Figure 3C:
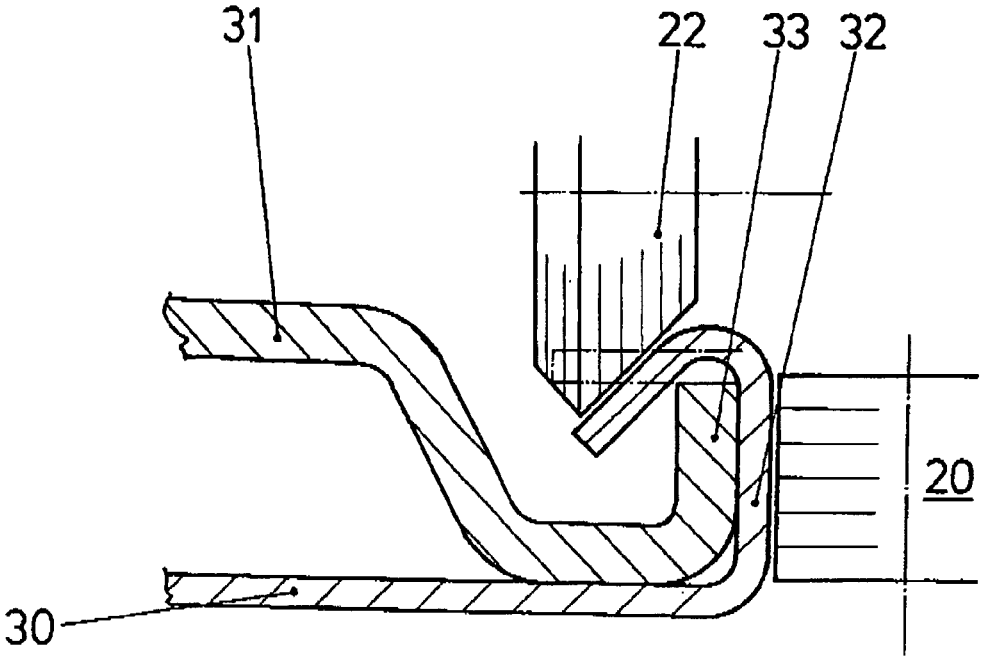

In the third step according to FIG. 3*c*, either a second roller folding head or a roller folding head of FIG. 2 is used. However, in this case the revolver head 24 is rotated further by one position, so that now the third counter-roller 22 is used. In this design the third pressure roller 20 is identical to the second pressure roller 9.

Figure 3D:
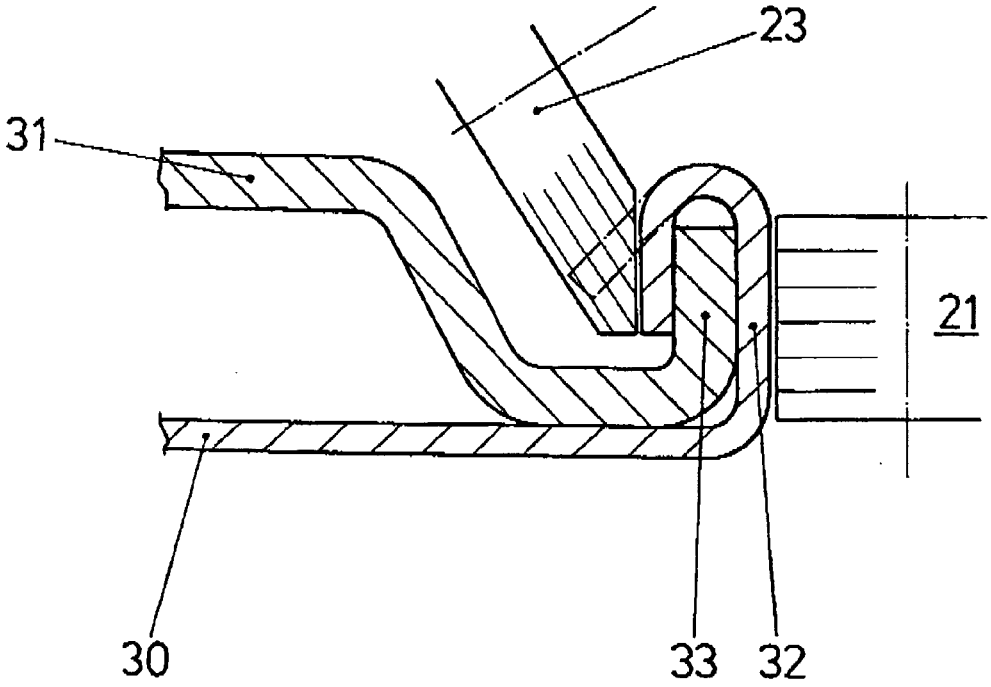

In the final operation of FIG. 3*d*, a fourth pressure roller 21 or a fourth counter-roller 23 is used. The fourth pair of rollers is formed either, according to FIG. 1, at a second roller folding head or is produced by rotating the revolver head 24, according to FIG. 2. The fourth pressure roller 21 in turn is depicted by the second pressure roller 9.

The individual positions are reached by always rotating the entire roller folding head 1 and by guiding the carrier 4 into the respective folding position by means of the carriage 5.

Thus, in the inventive method, the beading operation takes place in four steps, where at least in the first step the two flanges are pushed against each other by means of one pressure roller and one counter-roller; and a conically tapering segment of the pressure roller provides for one portion of the bead, and in the subsequent steps the subsequent portions of the bead are produced by the respective correspondingly oriented counter-rollers. Since in the subsequent steps the pressure roller has essentially the task of guiding the roller folding head at the flange, it can be a single cylindrical body, which rests against and then rolls off that segment of the flange that is not to be beaded. The counter-rollers, provided with a conically tapering segment, are oriented relative to the flange in accordance with the desired progress in the beading operation.

The invention claimed is:

1. A roller folding head for fastening to a robotic arm comprising a base body, a carriage adapted to slide along said base body, and two pairs of rollers, denoted as a first pair and a second pair, each pair of rollers comprising a pressure roller and a counter-roller, both of which interact to bend a flange at a specific angle along a folding line, one of said pressure rollers being rotatably mounted on the carriage, and further comprising a second carriage adapted to be moved relative to said base body, wherein the counter-roller of the first pair of rollers is mounted immoveably on the base body; and the counter-roller of the second pair of rollers is mounted rotatably on said second carriage.

2. A roller folding head, as claimed in claim 1, wherein both carriages are arranged on the base body such that they can be moved perpendicularly in opposite directions.

3. A roller folding head for fastening to a robotic arm comprising a base body, a carriage adapted to slide along said base body, and two pairs of rollers, denoted as a first pair and a second pair, each pair of rollers comprising a pressure roller and a counter-roller, both of which interact to bend a flange at a specific angle along a folding line, one of said pressure rollers being rotatably mounted on the carriage, wherein both counter-rollers are mounted rotatably in immoveable bearings on the base body.

4. A roller folding head for fastening to a robotic arm comprising a base body, a carriage adapted to slide along said base body, and two pairs of rollers, denoted as a first pair and a second pair, each pair of rollers comprising a pressure roller and a counter-roller, both of which interact to bend a flange at a specific angle along a folding line, one of said pressure rollers being rotatably mounted on the carriage, and wherein one of said pressure rollers is adapted to cooperate with a plurality of counter-rollers, and further comprising a revolver head connected to the base body, wherein the plurality of counter-rollers are coupled with said revolver head.

* * * * *